US007710344B2

(12) United States Patent
Deng et al.

(10) Patent No.: US 7,710,344 B2
(45) Date of Patent: May 4, 2010

(54) SINGLE POLE VERTICALLY POLARIZED VARIABLE AZIMUTH BEAMWIDTH ANTENNA FOR WIRELESS NETWORK

(75) Inventors: Gang Yi Deng, Irvine, CA (US); Bill Vassilakis, Orange, CA (US); Matthew J. Hunton, Liberty Lake, WA (US); Alexander Rabinovich, Cypress, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 0 days.

(21) Appl. No.: 12/074,473

(22) Filed: Mar. 4, 2008

(65) Prior Publication Data

US 2008/0218425 A1 Sep. 11, 2008

Related U.S. Application Data

(60) Provisional application No. 60/905,202, filed on Mar. 5, 2007.

(51) Int. Cl.
*H01Q 21/00* (2006.01)
*H01Q 19/06* (2006.01)
*H01Q 3/00* (2006.01)

(52) U.S. Cl. ..... 343/835; 343/754; 343/757

(58) Field of Classification Search ..... 343/757, 343/765, 754, 853, 834, 835
See application file for complete search history.

(56) References Cited

U.S. PATENT DOCUMENTS

| | | | | |
|---|---|---|---|---|
| 5,949,303 | A | 9/1999 | Arvidsson et al. | |
| 5,969,689 | A | 10/1999 | Martek et al. | |
| 6,756,939 | B2 | 6/2004 | Chen et al. | |
| 6,809,694 | B2 * | 10/2004 | Webb et al. | 343/754 |
| 6,864,837 | B2 | 3/2005 | Runyon et al. | |
| 6,922,169 | B2 | 7/2005 | Izzat et al. | |
| 6,950,061 | B2 * | 9/2005 | Howell et al. | 342/359 |
| 7,006,053 | B2 | 2/2006 | Zigler et al. | |
| 2007/0146222 | A1 * | 6/2007 | Mansour | 343/757 |
| 2007/0241979 | A1 * | 10/2007 | Yang | 343/765 |

OTHER PUBLICATIONS

International Search Authority, Written Opinion for International Application No. PCT/US08/02845 dated Jun. 2, 2008, 7 pages.

International Search Authority, Written Opinion for International Application No. PCT/US08/03176 dated Jun. 11, 2008, 8 pages.

* cited by examiner

*Primary Examiner*—Hoang V Nguyen
(74) *Attorney, Agent, or Firm*—Myers Andras Sherman LLP

(57) ABSTRACT

A single pole antenna array architecture provides an azimuth variable beamwidth. The array includes a number of driven radiating elements that are spatially arranged having a pivoting actuator so as to provide a controlled variation of the antenna array's radiation pattern.

16 Claims, 5 Drawing Sheets

SINGLE POLE VERTICALLY POLARIZED VARIABLE AZIMUTH BEAMWIDTH ANTENNA FOR WIRELESS NETWORK

The present application claims priority under 35 USC section 119(e) to U.S. Provisional Patent Application Ser. No. 60/905,202, filed Mar. 5, 2007, the disclosure of which is herein incorporated by reference in its entirety.

BACKGROUND OF THE INVENTION

1. Field of the Invention

The present invention relates in general to communication systems and components. More particularly the present invention is directed to antennas for wireless networks.

2. Description of the Prior Art and Related Background Information

Modern wireless antenna implementations, generally include a plurality of radiating elements that may be arranged over a ground plane defining a radiated (and received) signal beamwidth and azimuth scan angle. Azimuth antenna beamwidth can be advantageously modified by varying amplitude and phase of a Radio Frequency (RF) signal applied to respective radiating elements. Azimuth antenna beamwidth has been conventionally defined by Half Power Beam Width (HPBW) of the azimuth beam relative to a bore sight of an antenna array. In such an antenna array structure, radiating element positioning is critical to the overall beamwidth control as such antenna systems rely on accuracy of amplitude and phase angle of an RF signal supplied to each radiating element. This places a great deal of tolerance and accuracy on a mechanical phase shifter to provide required signal division between various radiating elements over various azimuth beamwidth settings.

Real world applications often call for an antenna array with beam down tilt and azimuth beamwidth control that may incorporate a plurality of mechanical phase shifters to achieve such functionality. Such highly functional antenna arrays are typically retrofitted in place of simpler, lighter and less functional antenna arrays while weight and wind loading of the newly installed antenna array can not be significantly increased. Accuracy of a mechanical phase shifter generally depends on its construction materials. Generally, highly accurate mechanical phase shifter implementations require substantial amounts of relatively expensive dielectric materials and rigid mechanical support. Such construction techniques result in additional size and weight, not to mention being relatively expensive. Additionally, mechanical phase shifter configurations that utilize lower cost materials may fail to provide adequate passive intermodulation suppression under high power RF signal levels.

Consequently, there is a need to provide a simpler method to adjust antenna beamwidth control.

SUMMARY OF THE INVENTION

One aspect of the invention provides an antenna for a wireless network. The antenna comprises a reflector, a plurality of radiators pivotally connected along a common axis and movable relative to the reflector, and an input port configured to feed a radio frequency (RF) signal to the radiators. The radiators are configurable at different adjustable angles relative to the reflector and to each other to provide variable signal beamwidth.

In a preferred embodiment of the invention, the radiators comprise vertically polarized radiator elements. The antenna preferably further comprises a plurality of actuator couplings coupled to the plurality of pivotal radiators and an actuator coupled to the plurality of actuator couplings. The input port is coupled to an RF power signal combining-divider network. The antenna preferably further comprising a multipurpose control port coupled to the RF power signal combining-divider network. The antenna may further comprise means for providing a plurality of azimuth beamwidth control signals coupled to an actuator via the multipurpose control port. The reflector is generally planar defined by a Y-axis, a Z-axis and an X-axis extending out of the plane of the reflector, wherein the actuator is configured to adjust positive and negative X-axis orientation of the plurality of radiators. The plurality of radiators are preferably spaced apart along the Z-axis direction and the plurality of radiators are pivotally adjustable about the Z-axis of the reflector. The plurality of radiators may be aligned vertically at a predetermined distance in the range of $\frac{1}{2}\lambda$-$1\lambda$ from one another in the Z-axis direction of the reflector where $\lambda$ is the wavelength corresponding to the operational frequency of the antenna. The plurality of radiators are pivotally adjustable between 0°-120° apart.

In another aspect the invention provides a vertically polarized variable azimuth beamwidth antenna, comprising a plurality of actuator couplings coupled to respective pivoting points, a plurality of vertically polarized radiators coupled to corresponding actuator couplings, and an actuator coupled to the plurality of actuator couplings. Signal beamwidth is adjusted based on positioning of the plurality of vertically polarized radiators to different relative angular orientations.

In a preferred embodiment of the invention, the antenna further comprises a reflector coupled to the plurality of aligned radiator dipoles, wherein the plurality of aligned radiator dipoles are positioned to adjust positive and negative X-axis orientation relative to a Z-axis of the reflector. The antenna may further comprise a signal-dividing-combining network coupled to the plurality of aligned radiator dipoles. The signal dividing-combining network may include a remotely controllable phase shifting network configured to provide elevation beam tilting. The actuator may be configured to move each radiator of the plurality of radiator dipoles. The antenna may further comprise a multipurpose port coupled to the actuator and a signal dividing-combining network to provide beamwidth control signals to the actuator. The plurality of radiators are preferably pivotally adjustable between 0°-120° apart.

In another aspect the invention provides a method of adjusting signal beamwidth in a wireless antenna having a plurality of radiators pivotally coupled along a common axis relative to a reflector. The method comprises adjusting the plurality of radiators to a first angle relative to the reflector and to each other to provide a first signal beamwidth. The method further comprises adjusting the plurality of radiators to a second angle relative to the reflector and to each other to provide a second signal beamwidth.

In a preferred embodiment, the method further comprises providing at least one beamwidth control signal for remotely controlling the plurality of radiators with an actuator responsive to the at least one beamwidth control signal. The method may further comprise moving the plurality of radiators in one of a positive and negative X-axis direction relative to the reflector via the actuator. The plurality of radiators may be pivotally adjusted between 0°-120° apart.

Further features and advantages of the present invention will be appreciated from the following detailed description of the invention.

DETAILED DESCRIPTION OF THE INVENTION

Reference will be made to the accompanying drawings, which assist in illustrating the various pertinent features of the present invention. The present invention will now be described primarily in solving aforementioned problems relating to use of a plurality of mechanical phase shifters. It should be expressly understood that the present invention may be applicable in other applications wherein beamwidth control is required or desired. In this regard, the following description of a single pole, antenna array equipped with pivotable radiating elements is presented for purposes of illustration and description. Furthermore, the description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

Figures 1A, 2A:
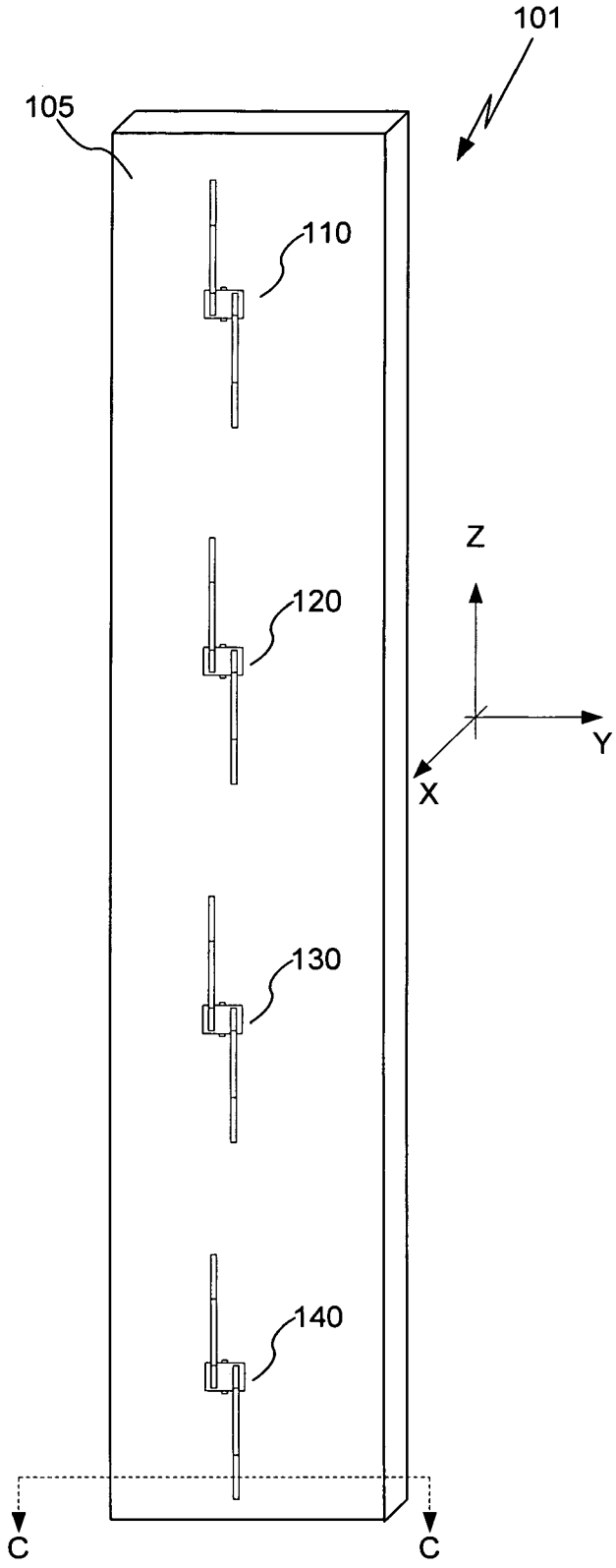
FIG. 1A illustrates a front view of a single column antenna array in a wide azimuth beamwidth setting.
FIG. 2A illustrates a cross section along line C-C in Z-view of a single column antenna array in wide azimuth beamwidth setting.

FIG. 1A shows a front view of an antenna array 101, according to an exemplary implementation, which utilizes a conventionally disposed reflector 105. Reflector 105 is oriented in a vertical orientation (Z-dimension) of the antenna array. The reflector 105, may, for example, consist of an electrically conductive plate suitable for use with Radio Frequency (RF) signals. Further, the plane of reflector 105 is shown as a featureless rectangle, but in actual practice additional features (not shown) may be added to aid reflector performance.

The antenna array 101 contains a plurality of RF radiators (110, 120, 130, 140) arranged vertically and preferably proximate to the vertical center axis of the reflector 105 plane and are vertically offset from one another. In one embodiment of the invention the plurality of RF radiators are aligned vertically at a predetermined distance in the range of ½λ-1λ from one another in the Z-axis direction on the reflector where λ is the wavelength of the RF operating frequency. Examples of frequencies of operation in a cellular network system are provided in table I. In one embodiment, the preferred number of vertically aligned RF radiators ranges between 2-15. In the illustrative non-limiting implementation shown, RF reflector 105, together with a plurality of vertically polarized dipole elements forms one embodiment of an antenna array useful for RF signal transmission and reception. However, it shall be understood that alternative radiating elements, such as taper slot antenna, horn, folded dipole, etc., can be used as well.

Figures 1B, 2B:
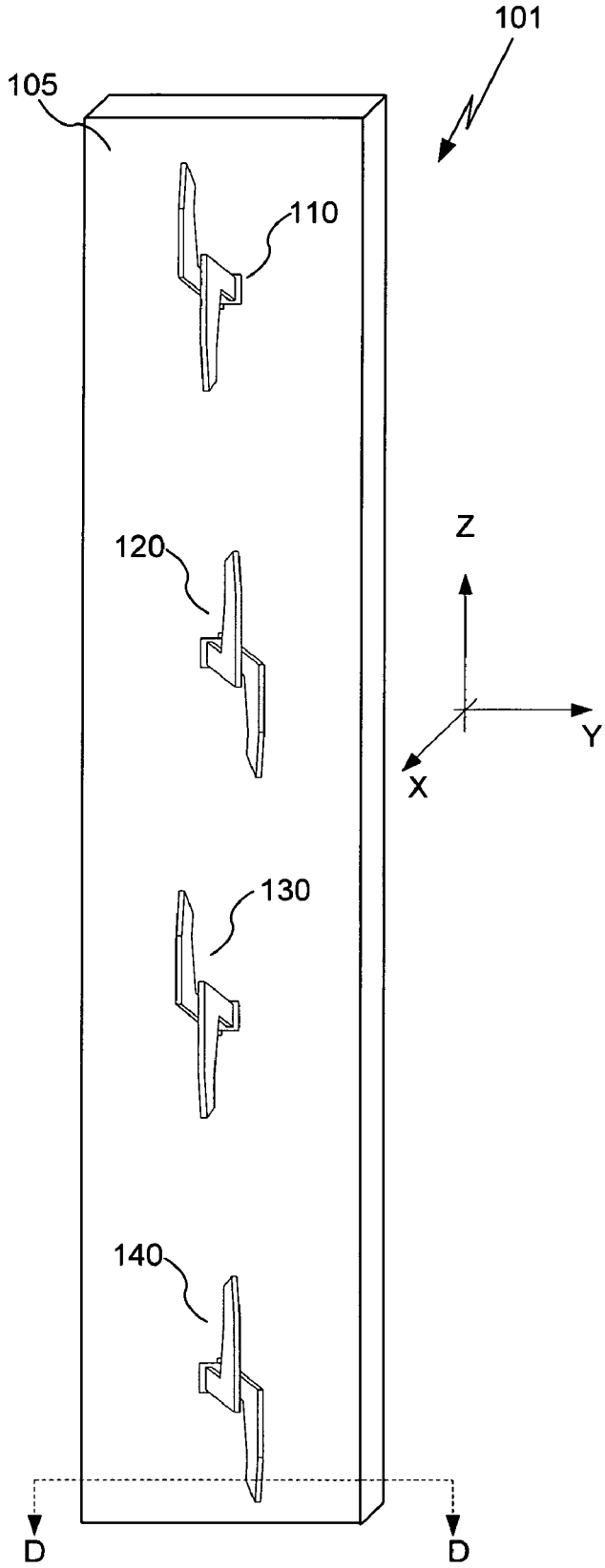
FIG. 1B illustrates a front view of a single column antenna array in narrow azimuth beamwidth setting.
FIG. 2B illustrates a cross section along line D-D in Z-view of a single column antenna array in a narrow azimuth beamwidth setting.
Figure 2A:
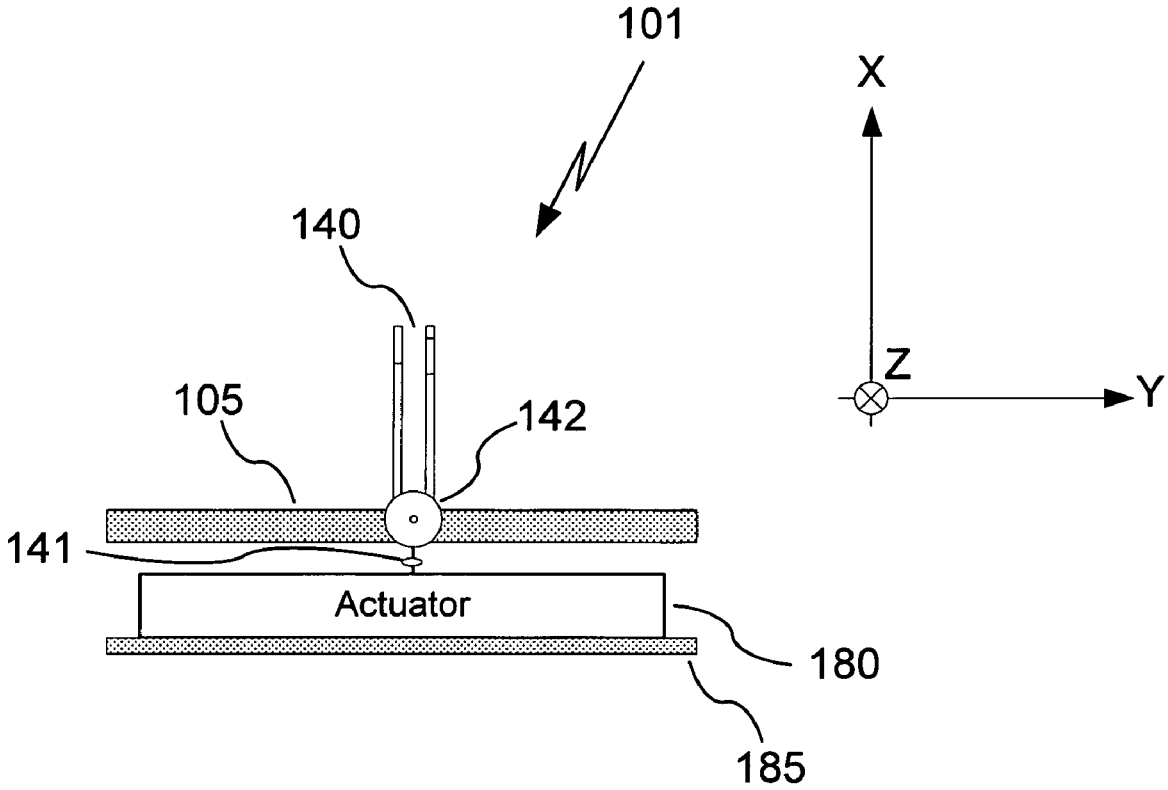
Figure 2B:
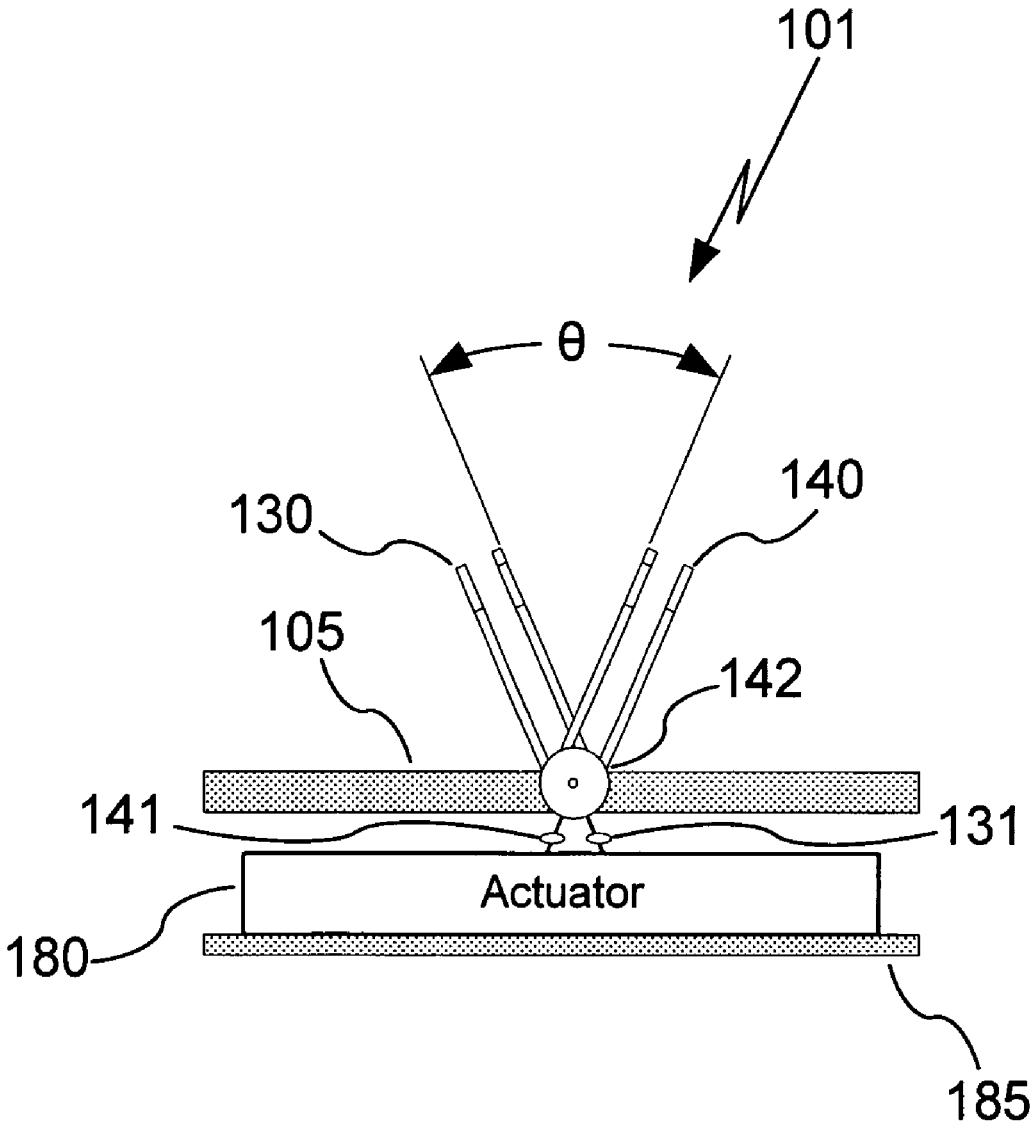
Figure 3A:
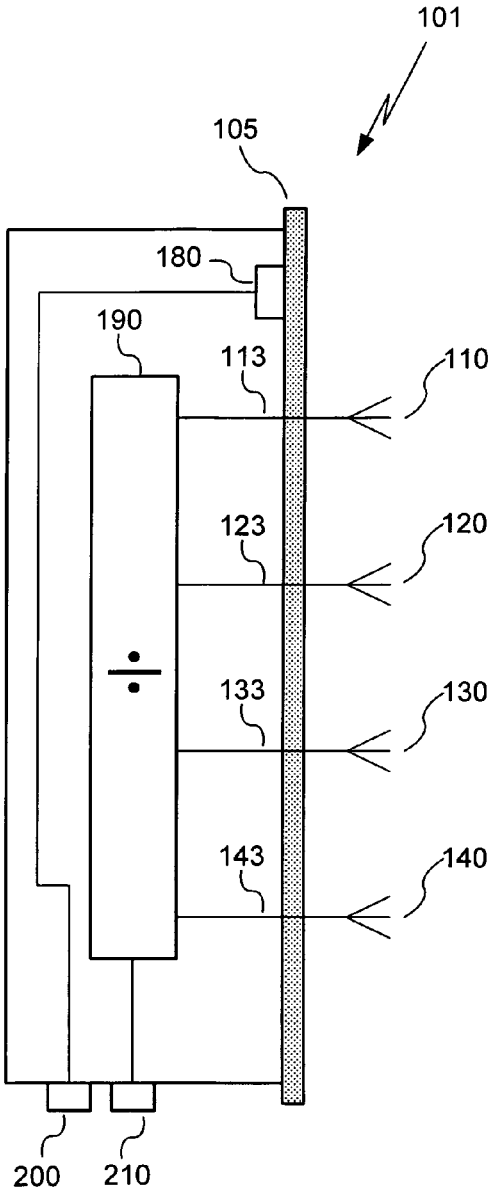
FIG. 3A illustrates a RF circuit diagram of a single column antenna array equipped with fixed down angle tilt and remotely controllable mechanically adjustable azimuth beamwidth.
Figure 3B:
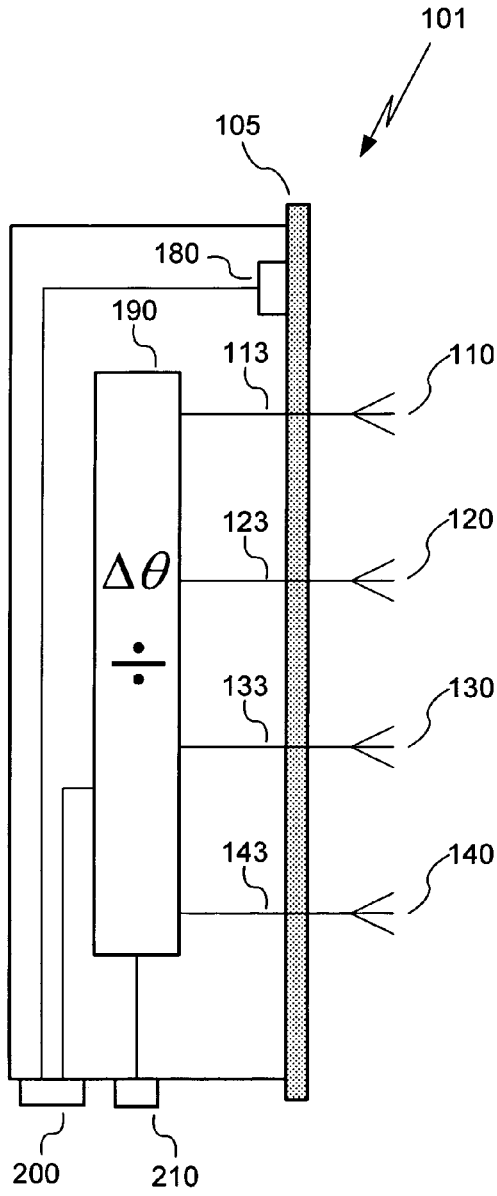
FIG. 3B illustrates a RF circuit diagram of a single column antenna array equipped with down angle tilt and remotely controllable mechanically adjustable azimuth beamwidth.

As illustrated in FIG. 3A-3B, RF radiator (110, 120, 130, 140) elements are fed from a single RF input port 210 with the same relative phase angle through a conventionally designed RF power signal dividing-combining 190 network. RF power signal dividing-combining 190 network output ports 113, 123, 133, 143 are coupled to corresponding radiating elements 110, 120, 130, 140. In some operational instances such an RF power signal dividing-combining network 190 may include a remotely controllable phase shifting network so as to provide beam tilting capability as described in U.S. Pat. No. 5,949,303 assigned to the current assignee and incorporated herein by reference in its entirety. Phase shifting functionality of the RF power signal dividing-combining network 190 may be remotely controlled via a multipurpose control port 200. Similarly, azimuth beamwidth control signals are coupled via multipurpose control port 200 to a mechanical actuator 180. Mechanical actuator 180 is rigidly attached to the back plate 185 of the antenna array 101 which is used for antenna array attachment (see also FIG. 2A-2B).

Each RF radiator (110, 120, 130, 140) element is mechanically attached to the reflector 105 plane with a corresponding, suitably constructed pivoting joint (112, 122, 132, 142-only 142 being shown but the other radiator elements 110, 120, 130 having corresponding structures 112, 122 and 132, respectively) which allows for both positive and negative X-dimension declination relative to the reflector 105 plane aligned along the vertical axis. As shown in FIGS. 2A and 2B each radiating element (110, 120, 130, 140) X-dimension angle, relative to the reflector 105 plane, is altered via mechanical actuator couplings (111, 121, 131, 141-only 131 and 141 are shown in FIG. 2B, corresponding to radiator elements 130, 140, respectively, but elements 110, 120 have identical structures 111, 121, respectively) mechanically controllable by actuator 180.

Consider an operational condition wherein RF radiators (110, 120, 130, 140) are aligned at 90 degrees relative to the reflector 105 plane. Such alignment setting will result in wide azimuth beamwidth. Conversely, if each RF radiator alternatively (110, 120, 130, 140) has its X-dimension orientation angle altered (relative to 90 degree) in the |+, −, +, −| sequence, for example 100, 80, 100, 80 degree orientation will result in narrower azimuth beamwidth. Additional examples are shown in Table I below, along with associated beamwidths (based on simulations).

Table I provides a listing of beamwidth for RF radiators adjusted apart from each other by 0°, 30°, 60°, 90° and 120° for an antenna array designed for continuous operation between 806 MHz and 960 MHz. Alternative frequency ranges are possible with appropriate selection of frequency sensitive components.

TABLE I

| RF Freq. (MHz) | Beamwidth θ = 0° apart (all elements are in line) | Beamwidth θ = 30° Apart | Beamwidth θ = 60° Apart | Beamwidth θ = 90° Apart | Beamwidth θ = 120° Apart |
|---|---|---|---|---|---|
| 806 | 90° | 84° | 79° | 69° | 58° |
| 883 | 87° | 80° | 76° | 65° | 54° |
| 960 | 86° | 77° | 73° | 62° | 50° |

One embodiment of the invention includes a method for providing variable signal beamwidth by actuating RF radiators. In this embodiment of the invention, phase shifting functionality of the RF power signal dividing-combining network 190 is remotely controlled via a multipurpose control port 200. Azimuth beamwidth control signals are coupled via multipurpose control port 200 to a mechanical actuator 180 to align the RF radiators to adjust beamwidth.

In this embodiment of the invention each RF radiator (110, 120, 130, 140) element is mechanically attached to the reflector 105 plane with a corresponding, suitably constructed pivoting joint (112, 122, 132, 142-only 142 being shown but the other radiator elements 110, 120, 130 having corresponding structures 112, 122 and 132, respectively) which allows for both positive and negative X-axis movement relative to the reflector 105 plane aligned along the vertical axis. In this method, each radiating element (110, 120, 130, 140) X-axis angle, relative to the reflector 105 plane, is altered via mechanical actuator couplings (111, 121, 131, 141-only 131 and 141 are shown in FIG. 2B, corresponding to radiator elements 130, 140, respectively, but elements 110, 120 have identical structures 111, 121, respectively) mechanically controllable by actuator 180 (e.g., a stepper motor, etc.). It should be noted in other embodiments that more than one actuator can be used to adjust the radiating elements.

In one embodiment, RF radiators (110, 120, 130, 140) are mechanically aligned at 90 degrees relative to the reflector 105 plane resulting in a wide azimuth beamwidth. Conversely, each RF radiator is alternatively (110, 120, 130, 140) adjusted to have its X-dimension orientation angle altered (relative to 90 degree) in the |+, −, +, −| sequence, for example 100, 80, 100, 80 degree orientation, resulting in a narrower azimuth beamwidth. Also, the alignment control may be set to any of the values in Table I as further examples.

Numerous modifications, alternative frequency range of operation of the above described illustrative embodiments will be apparent to those skilled in the art.

Reference Designator Listing

| Ref Des | Description |
|---|---|
| 101 | Vertical polarization single pole antenna array |
| 105 | Antenna Reflector |
| 110 | First Radiator Element (in this case a dipole) |
| 111 | First mechanical actuator coupling |
| 112 | First pivoting joint |
| 113 | First Radiator Element feed line to RF power dividing and combining network |
| 120 | Second Radiator Element (in this case a dipole) |
| 121 | Second mechanical actuator coupling |
| 122 | Second pivoting joint |
| 123 | Second Radiator Element feed line to RF power dividing and combining network |
| 130 | Third Radiator Element (in this case a dipole) |

-continued

Reference Designator Listing

| Ref Des | Description |
|---|---|
| 131 | Third mechanical actuator coupling |
| 132 | Third pivoting joint |
| 133 | Third Radiator Element feed line to RF power dividing and combining network |
| 140 | Fourth Radiator Element (in this case a dipole) |
| 141 | Fourth mechanical actuator coupling |
| 142 | Fourth pivoting joint |
| 143 | Fourth Radiator Element feed line to RF power dividing and combining network |
| 180 | Mechanical Actuator |
| 185 | Antenna back mounting plane |
| 190 | RF power dividing and combining network |
| 200 | Multipurpose communication port |
| 210 | Common RF port |

What is claimed is:

1. An antenna for a wireless network, comprising:

a reflector;

a plurality of radiators pivotally coupled along a common axis and movable relative to the reflector; and an input port configured to feed a radio frequency (RF) signal to the plurality of radiators, wherein the plurality of radiators are configurable at different adjustable angles relative to the reflector and to each other to provide variable signal beamwidth, wherein the plurality of radiators comprise vertically polarized radiator elements.

2. The antenna of claim 1, further comprising a plurality of actuator couplings coupled to the plurality of pivotal radiators and an actuator coupled to the plurality of actuator couplings.

3. The antenna of claim 1, wherein the input port is coupled to a RF power signal combining-divider network.

4. The antenna of claim 3, further comprising a multipurpose control port coupled to the RF power signal combining-divider network.

5. The antenna of claim 4, further comprising means for providing a plurality of azimuth beamwidth control signals coupled to an actuator via the multipurpose control port.

6. The antenna of claim 5, wherein the reflector is generally planar defined by a Y-axis, a Z-axis and an X-axis extending out of the plane of the reflector, wherein the actuator is configured to adjust positive and negative X-axis orientation of the plurality of radiators.

7. The antenna of claim 6, wherein the plurality of radiators are spaced apart along a Z-axis direction and the plurality of radiators are pivotally adjustable about the Z-axis of the reflector.

8. The antenna of claim 1, wherein the plurality of radiators are aligned vertically at a predetermined distance in the range of ½λ-1λ from one another in said Z-axis direction of the reflector where λ is the wavelength corresponding to the operational frequency of the antenna.

9. The antenna of claim 1, wherein the plurality of radiators are pivotally adjustable between 0°-120° apart.

10. A vertically polarized variable azimuth beamwidth antenna, comprising:

a plurality of actuator couplings coupled to respective pivoting points;

a plurality of vertically polarized radiators coupled to corresponding actuator couplings; and an actuator coupled to the plurality of actuator couplings, wherein signal beamwidth is adjusted based on positioning of the plurality of vertically polarized radiators to different relative angular orientations.

11. The antenna of claim 10, further comprising:

a reflector coupled to the plurality of vertically polarized radiators, wherein the plurality of vertically polarized radiators are positioned to adjust positive and negative X-axis orientation relative to a Z-axis of the reflector.

12. The antenna of claim 10, further comprising a signal-dividing-combining network coupled to the plurality of vertically polarized radiators.

13. The antenna of claim 12, wherein the signal dividing-combining network includes a remotely controllable phase shifting network configured to provide beam tilting.

14. The antenna of claim 10, wherein the actuator is configured to move each radiator of the plurality of vertically polarized radiators.

15. The antenna of claim 10, further comprising a multipurpose port coupled to the actuator and a signal dividing-combining network to provide beamwidth control signals to the actuator.

16. The antenna of claim 10, wherein the plurality of vertically polarized radiators are pivotally adjustable between 0°-120° apart.

* * * * *